US007163203B2

(12) United States Patent
Rodriguez

(10) Patent No.: US 7,163,203 B2
(45) Date of Patent: Jan. 16, 2007

(54) GAME

(76) Inventor: Aurelio Rodriguez, 5805 Orchard Ct., Apt. 4, Lansing, MI (US) 48911

( * ) Notice: Subject to any disclaimer, the term of this patent is extended or adjusted under 35 U.S.C. 154(b) by 0 days.

(21) Appl. No.: 11/085,085

(22) Filed: Mar. 22, 2005

(65) Prior Publication Data

US 2006/0214377 A1 Sep. 28, 2006

(51) Int. Cl.
*A63F 9/08* (2006.01)

(52) U.S. Cl. ..... 273/153 S; 273/153 R

(58) Field of Classification Search ..... 273/153 R, 273/153 S, 155

See application file for complete search history.

(56) References Cited

U.S. PATENT DOCUMENTS

| | | | | |
|---|---|---|---|---|
| 823,548 | A | 6/1906 | Randall | |
| 961,892 | A | 6/1910 | Peck | |
| 1,017,752 | A * | 2/1912 | Hardy | 273/153 S |
| 1,109,698 | A * | 9/1914 | Nelson, Jr. | 273/153 S |
| 1,191,135 | A * | 7/1916 | Moore, Sr. | 273/153 S |
| 4,422,641 | A | 12/1983 | Collin | |
| 4,546,979 | A * | 10/1985 | Knott | 273/153 S |
| 4,836,548 | A * | 6/1989 | Chittenden | 273/153 S |
| 4,927,150 | A | 5/1990 | Monoyios | |
| 5,423,556 | A * | 6/1995 | Latypov | 463/9 |
| 5,529,301 | A | 6/1996 | Feller | |
| D387,813 | S | 12/1997 | Fernandez et al. | |
| 5,725,213 | A | 3/1998 | Kuczynski | |
| 5,839,723 | A * | 11/1998 | Grimes | 273/109 |
| 6,116,600 | A * | 9/2000 | Aryan | 273/153 S |
| 6,203,014 | B1 * | 3/2001 | de Caussin | 273/153 R |
| D450,356 | S | 11/2001 | Ling | |

FOREIGN PATENT DOCUMENTS

GB 2184030 A * 6/1987

* cited by examiner

*Primary Examiner*—Raleigh W. Chiu
(74) *Attorney, Agent, or Firm*—John M. Naber; Dickinson Wright PLLC

(57) ABSTRACT

A game having at least two boards, each having a frame with a substantially flat surface, said board determinative of a playing level, an object piece, the frame having a playing surface with a predetermined entrance and exit, game pieces arranged to travel over the frame surface. The object piece and game pieces collectively should occupy less than the entire area of the frame surface wherein there remains an unoccupied space (such as half or equal to the area of the game piece). Pieces are allowed lateral movement within the frame where the object of the level is to permit the game piece to exit at the exit point to the next level of play. A puzzle strip may also be included. Other features could include magnetized surfaces, transparent sheets to secure the pieces. An embodiment of the game on a computer is also provided.

12 Claims, 8 Drawing Sheets

GAME

BACKGROUND OF THE INVENTION

1. Field of the Invention

The present invention relates to a game, and more particularly to a game having an object piece that may be moved from a playing surface through an opening disposed at an end of a frame.

2. Description of Related Art

Puzzles and games that are a source of entertainment, mental stimulation, and improving dexterity are well known in the art. Some puzzles move a game piece about a plane within a bounded frame from a start position to an end position by determining a proper sequence of moves to navigate around other game pieces to the end position. Another popular version of this type of game is to orient a sequence of game pieces to spell out words or complete a picture. In either case, a framework of pieces may be interlocked within a frame using game pieces having tongues and grooves. See, for example, U.S. Pat. No. 5,529,281 to Feller. An advantage of this type of framework is that the pieces are not lost and the player is prohibited from cheating. Game pieces are moved in one block increments based on the position of an open space within the framework.

One disadvantage of this type of framework is the difficulty in completing the task and a player may lose interest. Further, once the game is "solved" there may be little motivation for a user to continue play. It is also difficult to reset. Other games may include different sized pieces, along with a designated object piece. For example, see U.S. Pat. No. 5,725,213 to Kuczynski and U.S. Pat. No. 4,422,641 to Collin.

Attempts are known in the art to make these games more interesting and easier to reset using at least one opening on the frame where the game piece may slide out. See, for example, U.S. Pat. No. 4,927,150 to Monoyios. Although these types of games provide a means of removal, the design is simple and may be boring to a more experienced player after solving the puzzle the first time.

Thus, there is a desire and a need in the art to provide improvements to a game to make it not only easy to provide continuous entertainment, but also provide a more challenging game while aiding in improving the dexterity of the player. Additionally, there is also a need in the art for a computerized game for players that require more variety in graphics and difficulty in their game play.

SUMMARY OF THE INVENTION

Accordingly, it is an important aspect of the invention to provide a game of moving a game piece through a plurality of frames (levels), with each frame presenting a new challenge in task, complexity, or style.

Accordingly, one embodiment of the present invention provides a game having at least two boards each having a frame with a substantially flat surface, said board determinative of a playing level, an object piece, the frame having a playing surface that Includes at least one opening at a predetermined location to determine an entrance point for said object piece and at least one opening to determine an exit point for said object piece; a plurality of game pieces arranged to travel over said frame surface, said object piece and said plurality of game pieces collectively occupying less than the entire area of said frame surface wherein there remains an unoccupied space (such as half or equal to the area of the object piece); said object piece and game pieces configured to permit movement in lateral directions within said frame and into said unoccupied space to change relative positions of said pieces on the playing surface to move said object piece further along said surface towards said exit point from said entrance point, whereby said object piece may exit said frame to the entrance point of another board; and a puzzle strip having a space that separates said strip in half, a plurality of game pieces on one side having a first shape and the other having a second shape.

In accordance with another aspect of the present invention, the game may have first, second, third and fourth boards representing four levels of play. The boards are placed in succession and the puzzle strip is inserted between said third board and fourth board.

In accordance with another aspect of the present invention, the game pieces in the puzzle strip move by sliding a first piece into said space then a second piece jumps over the first piece in said space into the empty space left by that first piece; then a third piece slides into the space left by the second piece; the first piece will then be able to move into the empty space of the third piece by jumping over the third piece; said pieces will continue the slide and jump combination until said pieces have switched sides. The game piece may be a variety of shapes including circles and triangles.

In accordance with yet another aspect of the present invention, the object and game pieces are provided with attachment means, such as a magnet, whereby they are shiftably attached to said playing surface and movable along transverse axes, said attachment means confining said blocks over said playing surface.

In accordance with yet another aspect of the present invention, the game may have a transparent sheet encasing said frame to prevent said pieces from falling off said surface.

In accordance with yet another aspect of the present invention, the game may be embodied in a computer readable code on a computer readable storage device; and the computer readable code is executed using one or more computers having one or more computer readable storage devices, one or more memory management units and one or more input/output devices for communicating with a user of the game.

Other features of the present invention will become more apparent to persons having ordinary skill in the art to which the present invention pertains from the following description and claims taken in conjunction with the accompanying figures.

BRIEF DESCRIPTION OF THE DRAWINGS

The foregoing features, as well as other features, will become apparent with reference to the description and figures below, in which like numerals represent like elements, and in which.

DETAILED DESCRIPTION OF THE INVENTION

Figure 1:
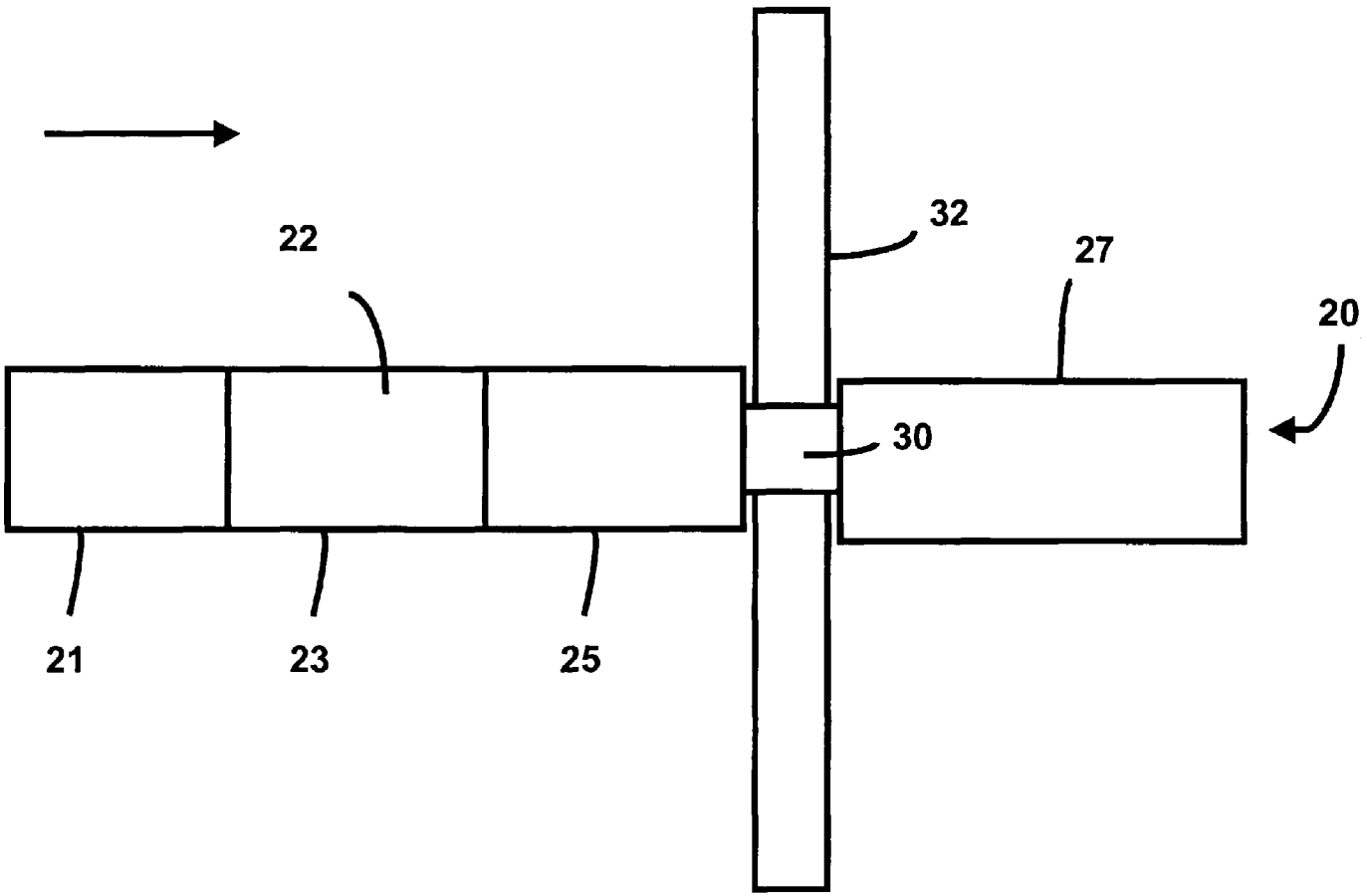
FIG. 1 is a top view of one embodiment of the game of the present invention.

The present invention provides a novel game puzzle for use in entertaining, mentally stimulating and improving a player's dexterity. An illustrated embodiment of the invention has slidable puzzle frames with pieces of various sizes confined within a frame to be maneuvered in lateral and horizontal directions until an object piece can be moved out of the frame into another level.

In an illustrated embodiment, the game generally has a board, a frame, a plurality of game pieces, a puzzle strip. The game board may optionally include a magnetized playing surface to secure puzzle pieces configured to be attracted to the magnetized surface when not in use or during transport. Another embodiment may provide a transparent sheet attached above the frame to prevent game pieces from falling off the board and a magnetic wand to move pieces configured to be attracted to the magnetized wand. The present invention may also be practiced in an electronic format such as a software application for a computer.

Referring now more particularly to the figures, there is seen in FIGS. 1–6 components of a possible embodiment of the present invention game generally shown at 20. The game 20, as illustrated, may include: a plurality of boards 22, each having a frame 21, 23, 25 and 27 defining a playing surface and representing a level of play; a puzzle strip 32; a magnet (not shown); an object piece 26; and a plurality of game pieces 28, which are positioned on board 22; a start point 34; and an end point 36. Game 20 may also include a transparent sheet attached above frames 21, 23, 25 and 27 to provide an embodiment that is readily mobile and will not allow game pieces 28 to fall off board 22. The present invention may be practiced in a variety of shapes and sizes and made from a variety of materials such as a wood or a high impact plastic. When a magnetized surface or magnetic wand is used, the games pieces are configured to be attracted to the magnetized surface or object.

Generally, the present invention provides a game of moving an object piece through a plurality of frames (levels), with each frame presenting a new challenge in task, complexity, or style. The present invention game may be practiced through a variety of means, such as loose game pieces placed on a frame through an encasement within a transparent sheet, magnetized pieces on a metal framework, or even played on a computer. In any case, the invention goal remains the movement of the object piece through the various levels.

The present invention game is played by a user placing an object piece in a start position of a first level of play, or to resume play where he last finished. The present invention may have an overall configuration as illustrated in FIG. 1, wherein there are five levels involving movement of the object piece through four frameworks and one puzzle. Each level should be solved before the game piece may travel to the next framework.

Figure 2:
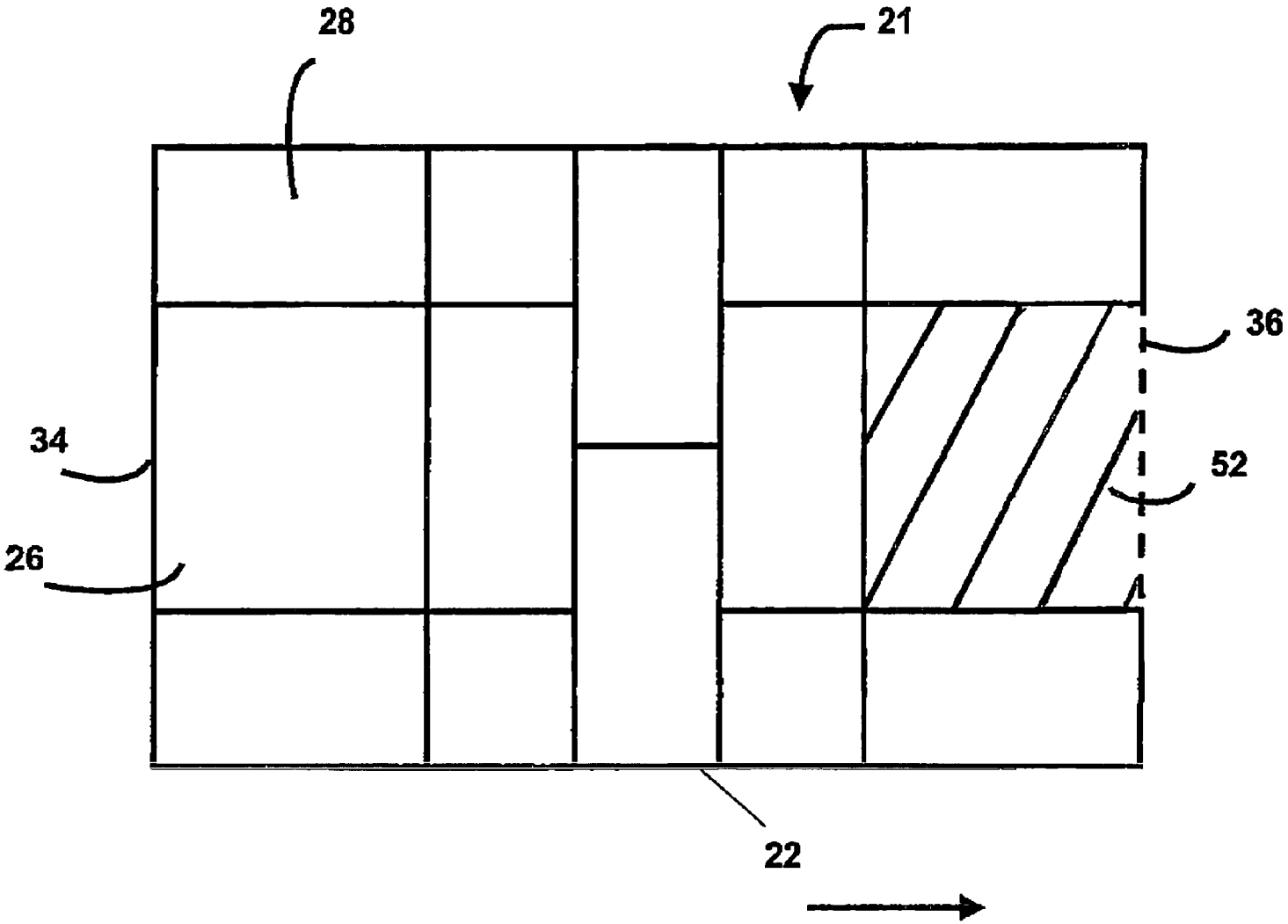
FIG. 2 is a top view of a first level of a game of the present invention.

Game 20 play can be explained as follows, though numerous other ways to practice this invention are possible within the scope of the invention. In a first frame 21, as shown in FIG. 2, an object piece 26 is placed at start point 34. Each frame requires at least one blank space 52 that is configured to object piece 26 upon completion of the preceding level. Space 52 can vary in size depending on the difficulty level of play. For example, it may be at least one half the size or the size of object piece 26. As shown in FIG. 2, game pieces 28 and object piece 26 are arranged within frame 21 (Level 1). Game pieces 28 include six rectangular blocks, six small squares, and one large square. Space 52 is defined on top of board 22 and is of such a size for reception of said object piece 26 to enable the pieces to be shifted.

The object of the game 20 (or puzzle) is to move object piece 26 that is initially centered at start position 34 at one end of frame 21 shown in FIG. 2, by shifting game pieces 28 to make way for object piece 26 to be displaced from its starting point 34 to its end pot 36 where it may be removed to go to the next level.

The present embodiment, as illustrated in FIG. 1 is divided into separate levels, each with a unique challenge and generally increasing in complexity with each successive level. Each level, as illustrated, is generally described as follows:

Level 1: Referring now to FIG. 2, game pieces 28 are shown arranged within frame 21. Game pieces 28, as shown in frame 21, comprise six rectangular blocks, six small squares, and one large square configured around empty space 52 that is equal to the size of the large square. Object piece 26 is initially centered at one end of the board at starting point 34 and the object is to maneuver it to the center of the opposite end where it may be removed at end point 36 in order to go to the next level.

Figure 3:
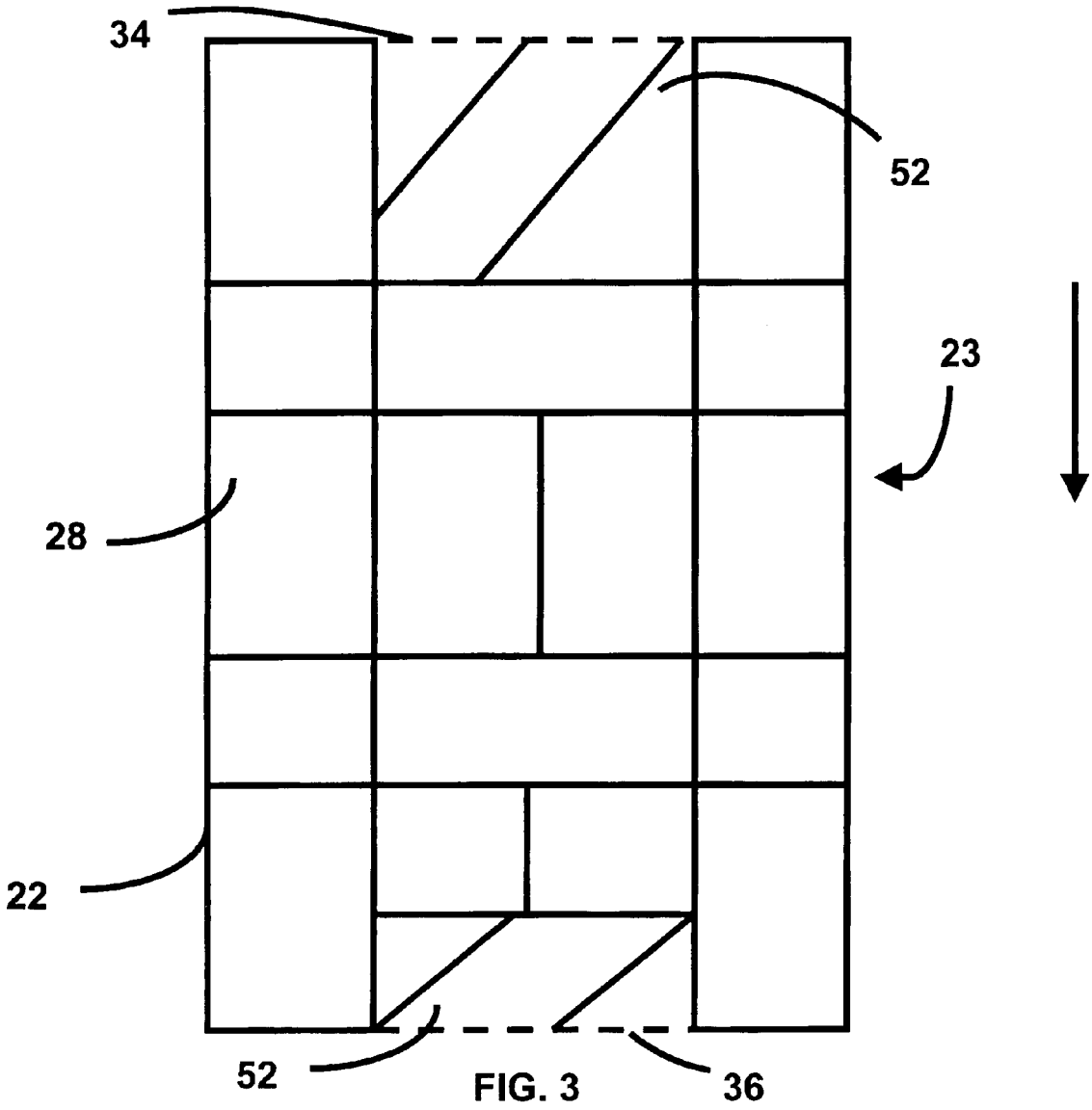
FIG. 3 is a top view of a second level of a game of the present invention.

Level 2: Referring now to FIG. 3, game pieces 28 are arranged within frame 23. Game pieces 28 include ten rectangular pieces and six small squares configured around space 52 that is at least one half the size of object piece 26 and up to equal to the size of the larger square. Object piece 26 is moved from end point 36 of Level 1 to starting point 34 of Level 2 and maneuvered through frame 23 to the end point 36 where it may be removed to go to the next level.

Figure 4:
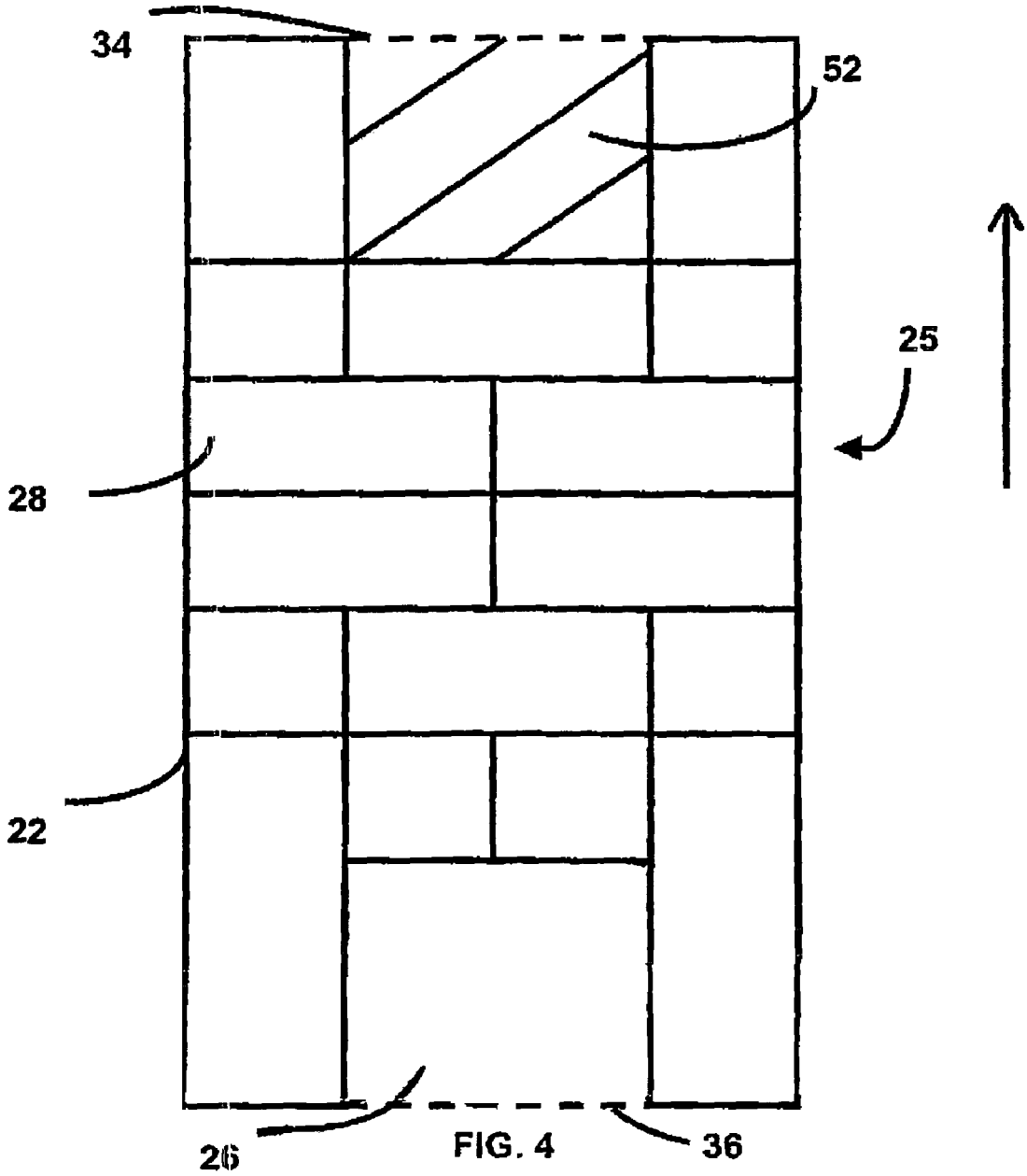
FIG. 4 is a top view of a third level of a game of the present invention.

Level 3: Referring now to FIG. 4, game pieces 28 are shown arranged within frame 25. Game pieces 28 at this level comprise ten rectangular blocks, six small squares, and one large square within frame 25 and are configured around space 52 that is equal to the size of the larger square. Object piece 26 is moved from end point 36 of Level 2 to starting point 34 of Level 3 and maneuvered through frame 25 to the end point 36 where it may be removed to go to the next level.

Figure 5:
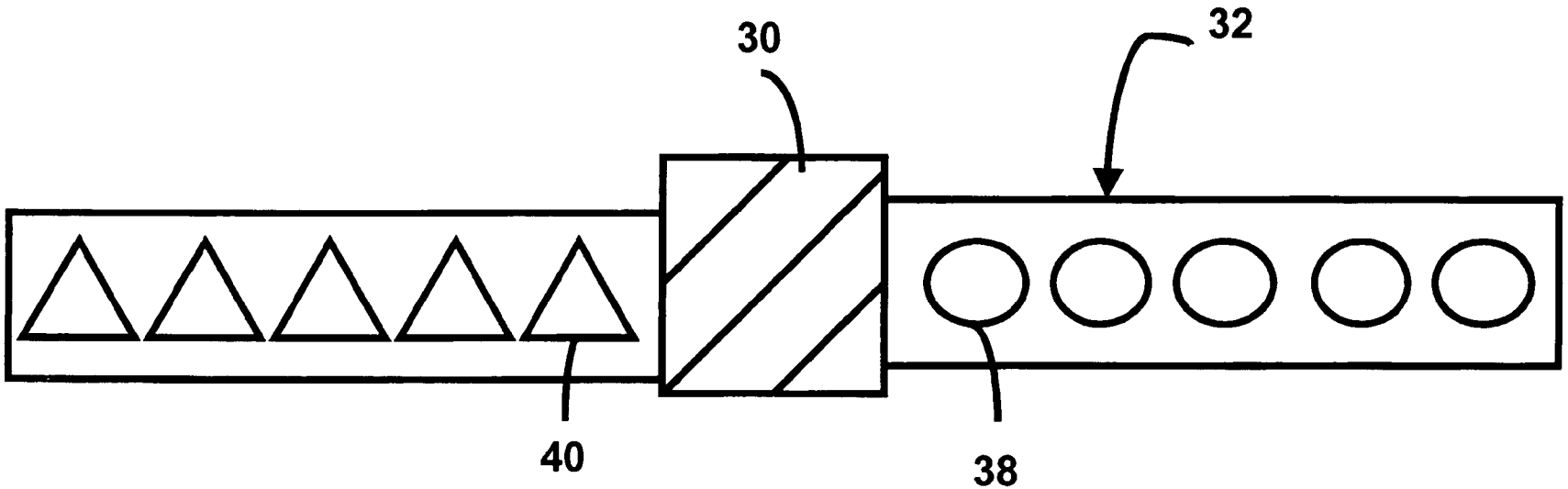
FIG. 5 is a top view of a fourth level of a game of the present invention.

Level 4: Referring to FIG. 5, Level 4 consists of puzzle strip 32 with space 30 in the center. To the right of space 30, puzzle strip 32 has five puzzle pieces 28 that are circles 38 while to the left of space 30 there a five game pieces 28 that are triangles 40. The object of this level is to shift circles 38 from the right of spaces 30 to the left and to shift triangles 40 located to the left of space 30 previously occupied by the circles 38 to the right. The player is allowed to move one puzzle piece 28 (circle 38 or triangle 40) at a time. This level starts by the player moving either the triangle 40 or the circle 38 into space 30. Then he will move a second piece by jumping over the first piece in space 30 into the empty space left by that first piece. The player then slides a third piece into the space left by the second piece. The first piece will then be able to move into the empty space of the third piece by jumping over the third piece. The player will continue this slide and jump combination until 40 and circles 38 have switched sides. Once this is accomplished, the player is able to move to Level 5 (frame 27), the last level of the game.

Figure 6:
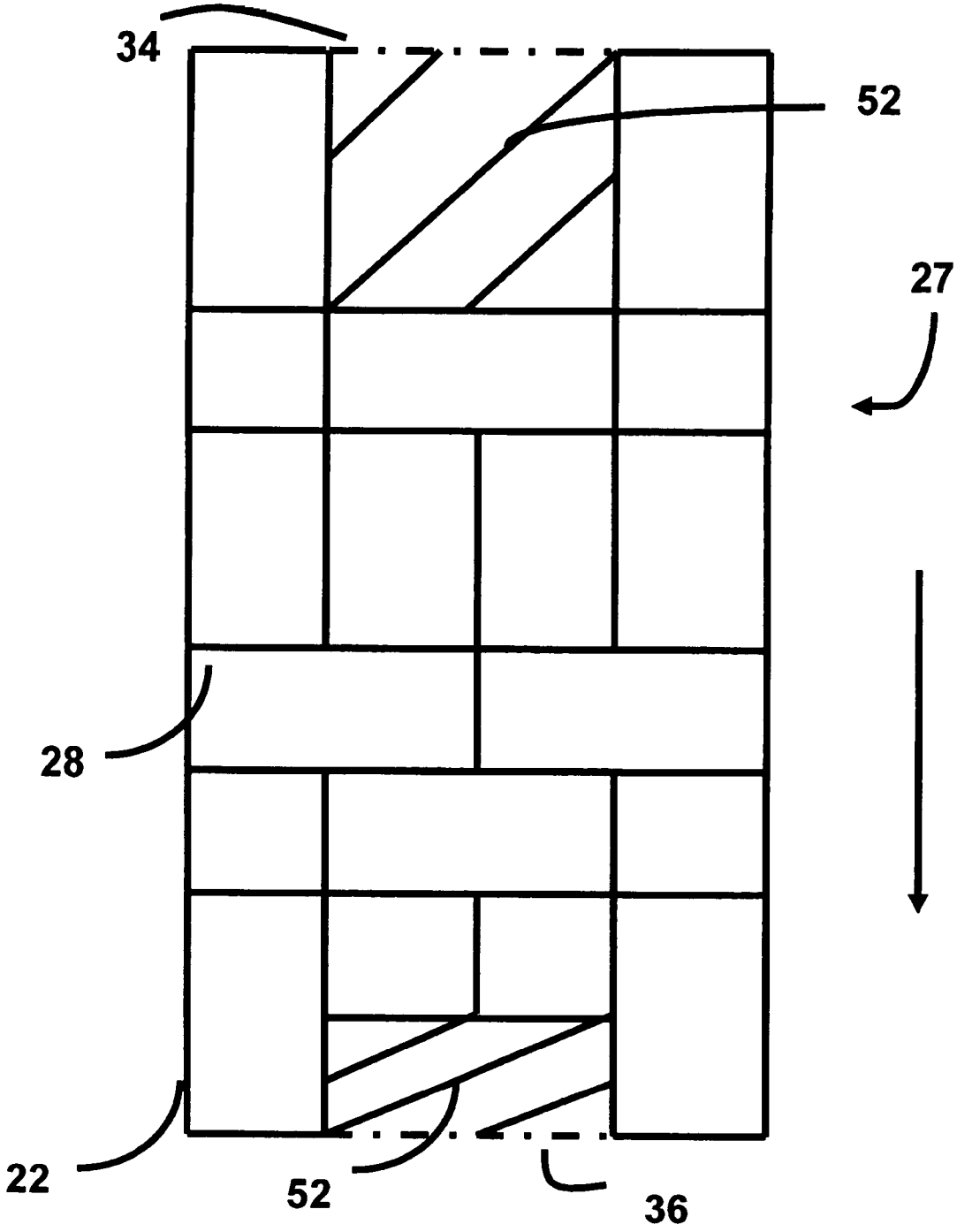
FIG. 6 is a top view of a fifth level of a game of the present invention.

Level 5: Referring to FIG. 6, game pieces 28 are shown arranged within a frame 27. Game pieces 28 are twelve rectangular blocks and six small squares configured around space 52 to receive object piece 26. This level of the game is played similarly as Level 1, 2, and 3. Object piece 26 is removed from the end point 36 of Level 3 and placed at the starting point 34 of Level 5 and maneuvered through frame 27 and removed at end point 36. Once piece 26 removed from end point 36 of Level 5, the game is completed.

In yet another embodiment, which can include the variations described above, the present invention may be configured to run on a computer. In this embodiment, the game may be embodied in a computer readable code on a computer readable storage device, wherein the computer readable code is executed using one or more microprocessors, computers, or central processing units having one or more computer readable storage devices, one or more memory management units and one or more input/output devices for communicating with individuals or groups of individuals using the multi-disciplinary tool. The game may be developed in Microsoft C#.NET and configured to work on operating systems such as those sold under the brand name; WINDOWS 98®, WINDOWS ME®, WINDOWS 2000®, WINDOWS XP® and WINDOWS 2003® and the like.

Figure 7:
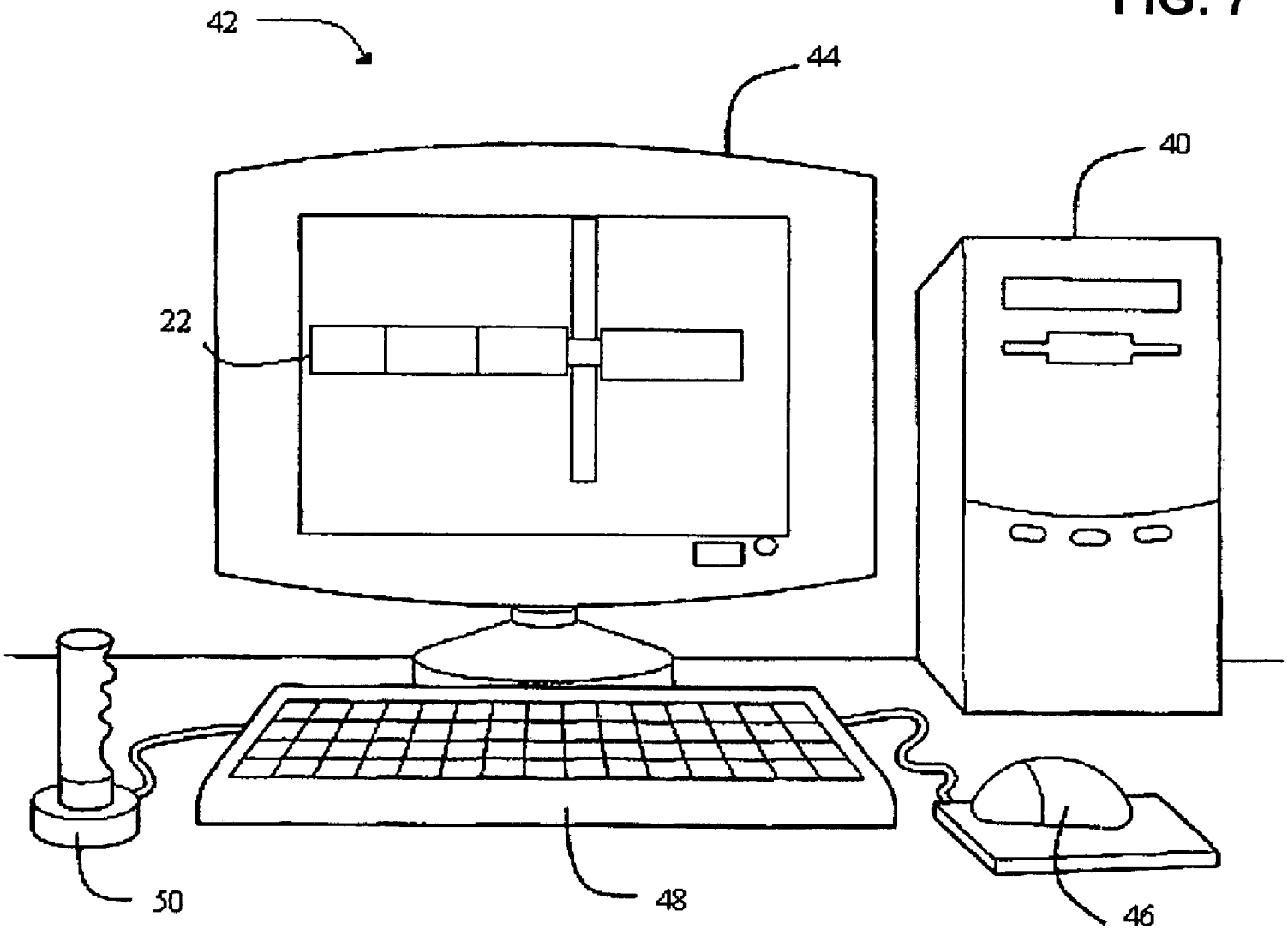
FIG. 7 illustrates an embodiment of the present invention played on a computer.
Figure 8:
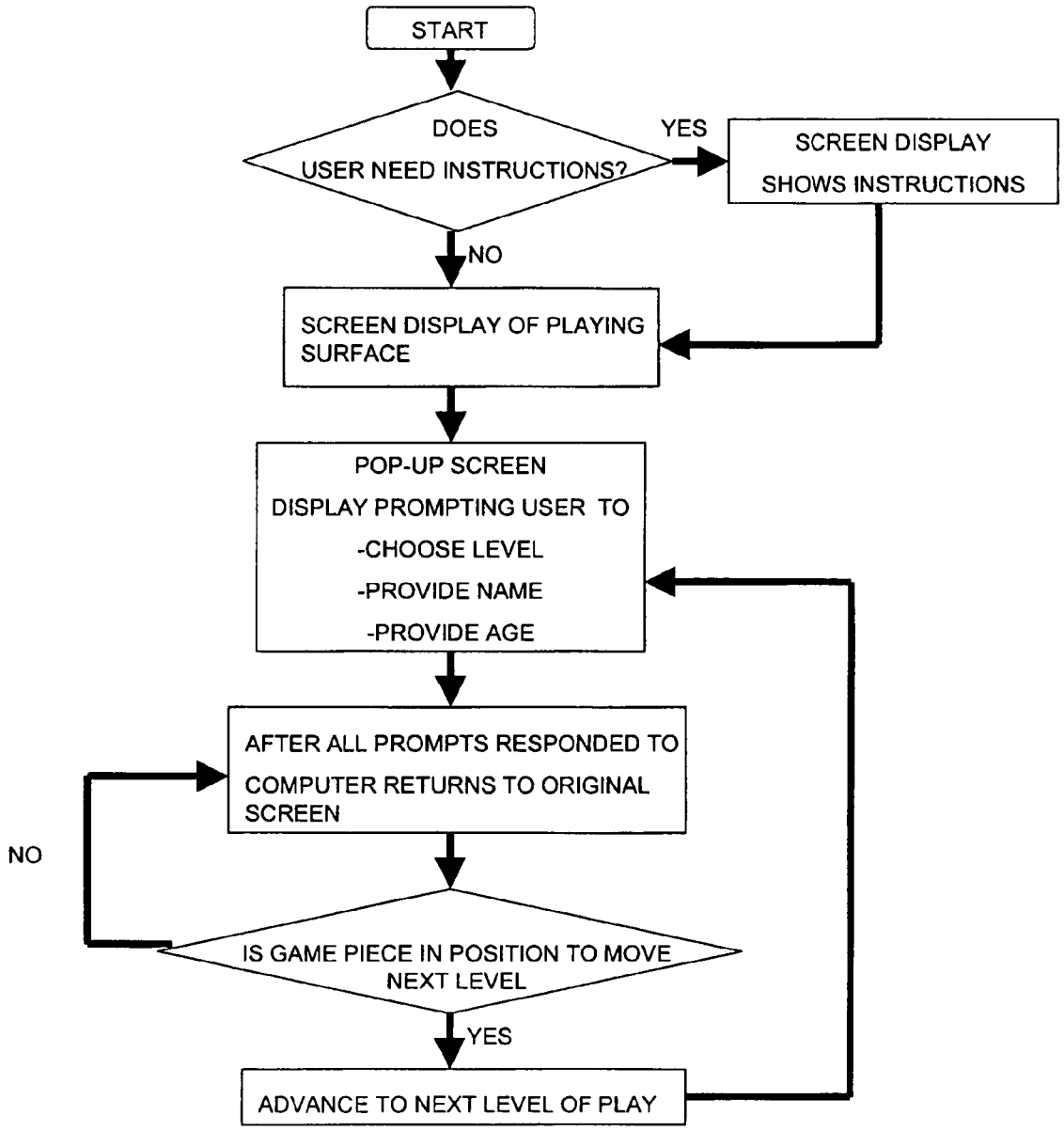
FIG. 8 illustrates a schematic representation of program flow followed as the present invention is played on a computer.

As shown in FIG. 7, in an alternate embodiment, the present invention game may be played on a computer 42 in an interactive fashion. The multiple level format is well suited for computer applications, unlike the prior art. In such an embodiment, board 22 may be represented on a computer monitor 44. The computer 42 includes input devices, so that players may interact with the computer. Although the preferred input device 46 is a mouse, other devices including, but not limited to, a keyboard 48 or a joystick 50, may also be used, as desired. The goals of the alternate computerized embodiment of the present invention are substantially the same as in the embodiment previously described. The computer 42 could follow a flow path depicted in FIG. 8.

In the computerized embodiment of the present invention, the activity is conducted by one player at a time after initial instructions or directions are offered by the computer. At the beginning of this interactive activity, the user could log on with name and age a selection of a level to work from. The questions and content of the activity could then be tailored accordingly.

As seen in FIG. 7, the computer monitor 44 may initially display board 22. Various verbal prompts, background noises, and graphical images can be generated by the computer 42. The player might click on a level that will generate a pop-up screen. Again the program may add various sight and sounds to illustrate the level. Ultimately play can stop by a user command or by failure complete a level. The computer 42 would follow a flow path depicted in FIG. 8.

While the invention has been described in conjunction with specific embodiments, it is evident that many alternatives, modifications and variations will be apparent to those skilled in the art in light of the foregoing description. Accordingly, the present invention attempts to embrace all such alternatives, modifications and variations that fall within the spirit and scope of the appended claims.

The invention claimed is:

1. A game, comprising:

at least two boards each having a frame with a substantially flat surface, said board determinative of a playing level;

an object piece;

said from having a playing surface that includes at least one opening at a predetermined location to determine an entrance point for said object piece and at least one opening to determine an exit point for said object piece;

a plurality of game pieces arranged to travel over said frame surface, said object piece and said plurality of game pieces collectively occupying less than the entire area of said frame surface wherein there remains an unoccupied space;

said object piece and game pieces configured to permit movement in lateral directions within said frame and into said unoccupied space to change relative positions of said pieces on the playing surface to move said game piece further along said surface towards said exit point from said entrance point, whereby said object piece may exit said frame to the entrance point of another board; and a puzzle strip having a space that separates said strip in half, a plurality of game pieces on one side having a first shape and the other having a second shape.

2. The game of claim 1, wherein said game has first, second, third and four boards representing four levels of play.

3. The game of claim 2, wherein said boards are placed in succession and said puzzle strip is inserted between said third board and fourth board.

4. The game of claim 1, wherein said game pieces in said puzzle strip move by sliding a first piece into said space then a second piece jumps over the first piece in said space into the empty space left by that first piece; then a third piece slides into the space left by the second piece; the first piece will then be able to move into the empty space of the third piece by jumping over the third piece; said pieces will continue the slide and jump combination until said pieces have switched sides.

5. The game of claim 1, wherein at least one game piece is of a rectangular shape.

6. The game of claim 1, wherein at least one game piece is of a square shape.

7. The game of claim 1, wherein said object and said game pieces are provided with attachment means whereby they are shiftably attached to said playing surface and movable along transverse axes, said attachment means confining said blocks over said playing surface.

8. The game of claim 7, wherein said attachment is a magnet that is moved over the outer surface of said playing surface.

9. The game of claim 1, wherein said game has a transparent sheet encasing said frame to prevent said pieces from falling off said surface.

10. The game of claim 1, wherein said unoccupied space is at least half the size of the object piece.

11. The game of claim 1, wherein said unoccupied space is at least the size of the object piece.

12. The game of claim 1, wherein said game is embodied in a computer readable code on a computer readable storage device; and the computer readable code is executed using one or more computers having one or more computer readable storage devices, one or more memory management units and one or more input/output devise for communicating with a user of the game.

* * * * *